US008403080B2

(12) United States Patent
Mirchandani et al.

(10) Patent No.: US 8,403,080 B2
(45) Date of Patent: Mar. 26, 2013

(54) EARTH-BORING TOOLS AND COMPONENTS THEREOF INCLUDING MATERIAL HAVING HARD PHASE IN A METALLIC BINDER, AND METALLIC BINDER COMPOSITIONS FOR USE IN FORMING SUCH TOOLS AND COMPONENTS

(75) Inventors: Prakash K. Mirchandani, Hampton Cove, AL (US); Jimmy W. Eason, The Woodlands, TX (US); James J. Oakes, Murfreesboro, TN (US); James C. Westhoff, The Woodlands, TX (US); Gabriel B. Collins, Huntsville, AL (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/309,232

(22) Filed: Dec. 1, 2011

(65) Prior Publication Data

US 2012/0097455 A1 Apr. 26, 2012

Related U.S. Application Data

(62) Division of application No. 12/192,292, filed on Aug. 15, 2008, now Pat. No. 8,172,914, which is a division of application No. 10/848,437, filed on May 18, 2004, now abandoned.

(60) Provisional application No. 60/566,063, filed on Apr. 28, 2004.

(51) Int. Cl.
*E21B 10/46* (2006.01)

(52) U.S. Cl. ..... 175/425; 175/374

(58) Field of Classification Search ..... None
See application file for complete search history.

(56) References Cited

U.S. PATENT DOCUMENTS

| | | | | |
|---|---|---|---|---|
| 2,299,207 | A | 10/1942 | Bevillard | |
| 2,819,958 | A | 1/1958 | Abkowitz et al. | |
| 2,819,959 | A | 1/1958 | Abkowitz et al. | |
| 2,906,654 | A | 9/1959 | Abkowitz | |
| 3,368,881 | A | 2/1968 | Abkowtiz et al. | |
| 3,471,921 | A | 10/1969 | Feenstra | |
| 3,660,050 | A | 5/1972 | Iler et al. | |
| 3,757,879 | A | 9/1973 | Wilder et al. | |
| 3,800,891 | A * | 4/1974 | White et al. | 175/374 |
| 3,942,954 | A | 3/1976 | Frehn | |
| 3,987,859 | A | 10/1976 | Lichte | |
| 4,017,480 | A | 4/1977 | Baum | |
| 4,047,828 | A | 9/1977 | Makely | |

(Continued)

FOREIGN PATENT DOCUMENTS

| | | |
|---|---|---|
| AU | 695583 | 2/1998 |
| CA | 2212197 | 10/2000 |

(Continued)

OTHER PUBLICATIONS

US 4,966,627, 09/1990, Keshavan et al. (withdrawn).

(Continued)

*Primary Examiner* — Zakiya W Bates
(74) *Attorney, Agent, or Firm* — TraskBritt

(57) ABSTRACT

Binder compositions for use in forming a bit body of an earth-boring bit includes at least one of cobalt, nickel, and iron, and at least one melting point-reducing constituent selected from at least one of a transition metal carbide up to 60 weight percent, a transition metal boride up to 60 weight percent, and a transition metal silicide up to 60 weight percent, wherein the weight percentages are based on the total weight of the binder. Earth-boring bit bodies include a cemented tungsten carbide material comprising tungsten carbide and a metallic binder, wherein the tungsten carbide comprises greater than 75 volume percent of the cemented tungsten carbide material.

16 Claims, 13 Drawing Sheets

U.S. PATENT DOCUMENTS

| | | | | |
|---|---|---|---|---|
| 4,094,709 | A | | 6/1978 | Rozmus |
| 4,128,136 | A | | 12/1978 | Generoux |
| 4,198,233 | A | | 4/1980 | Frehn |
| 4,221,270 | A | | 9/1980 | Vezirian |
| 4,229,638 | A | | 10/1980 | Lichte |
| 4,233,720 | A | | 11/1980 | Rozmus |
| 4,255,165 | A | | 3/1981 | Dennis et al. |
| 4,276,788 | A | | 7/1981 | van Nederveen |
| 4,306,139 | A | | 12/1981 | Shinozaki et al. |
| 4,334,928 | A | * | 6/1982 | Hara et al. ..... 75/238 |
| 4,341,557 | A | | 7/1982 | Lizenby |
| 4,351,401 | A | | 9/1982 | Fielder |
| 4,389,952 | A | | 6/1983 | Dreier et al. |
| 4,398,952 | A | | 8/1983 | Drake |
| 4,423,646 | A | | 1/1984 | Bernhardt |
| 4,499,048 | A | | 2/1985 | Hanejko |
| 4,499,795 | A | | 2/1985 | Radtke |
| 4,520,882 | A | | 6/1985 | van Nederveen |
| 4,526,748 | A | | 7/1985 | Rozmus |
| 4,547,337 | A | | 10/1985 | Rozmus |
| 4,552,232 | A | | 11/1985 | Frear |
| 4,554,130 | A | | 11/1985 | Ecer |
| 4,562,990 | A | | 1/1986 | Rose |
| 4,579,713 | A | | 4/1986 | Lueth |
| 4,596,694 | A | | 6/1986 | Rozmus |
| 4,597,456 | A | | 7/1986 | Ecer |
| 4,597,730 | A | | 7/1986 | Rozmus |
| 4,630,693 | A | | 12/1986 | Goodfellow |
| 4,656,002 | A | | 4/1987 | Lizenby et al. |
| 4,667,756 | A | | 5/1987 | King et al. |
| 4,686,080 | A | | 8/1987 | Hara et al. |
| 4,694,919 | A | | 9/1987 | Barr |
| 4,743,515 | A | | 5/1988 | Fischer et al. |
| 4,744,943 | A | | 5/1988 | Timm |
| 4,780,274 | A | | 10/1988 | Barr |
| 4,804,049 | A | | 2/1989 | Barr |
| 4,809,903 | A | | 3/1989 | Eylon et al. |
| 4,838,366 | A | | 6/1989 | Jones |
| 4,871,377 | A | | 10/1989 | Frushour |
| 4,884,477 | A | | 12/1989 | Smith et al. |
| 4,889,017 | A | | 12/1989 | Fuller et al. |
| 4,899,838 | A | | 2/1990 | Sullivan et al. |
| 4,919,013 | A | | 4/1990 | Smith et al. |
| 4,923,512 | A | | 5/1990 | Timm et al. |
| 4,956,012 | A | | 9/1990 | Jacobs et al. |
| 4,968,348 | A | | 11/1990 | Abkowitz et al. |
| 4,991,670 | A | | 2/1991 | Fuller et al. |
| 5,000,273 | A | | 3/1991 | Horton et al. |
| 5,010,945 | A | | 4/1991 | Burke |
| 5,030,598 | A | | 7/1991 | Hsieh |
| 5,032,352 | A | | 7/1991 | Meeks et al. |
| 5,049,450 | A | | 9/1991 | Dorfman et al. |
| 5,090,491 | A | | 2/1992 | Tibbitts et al. |
| 5,092,412 | A | | 3/1992 | Walk |
| 5,161,898 | A | | 11/1992 | Drake |
| 5,232,522 | A | | 8/1993 | Doktycz et al. |
| 5,281,260 | A | | 1/1994 | Kumar et al. |
| 5,286,685 | A | | 2/1994 | Schoennahl et al. |
| 5,311,958 | A | | 5/1994 | Isbell et al. |
| 5,348,806 | A | | 9/1994 | Kojo et al. |
| 5,373,907 | A | | 12/1994 | Weaver |
| 5,433,280 | A | | 7/1995 | Smith |
| 5,443,337 | A | | 8/1995 | Katayama |
| 5,452,771 | A | | 9/1995 | Blackman et al. |
| 5,479,997 | A | | 1/1996 | Scott et al. |
| 5,482,670 | A | | 1/1996 | Hong |
| 5,484,468 | A | | 1/1996 | Ostlund et al. |
| 5,506,055 | A | | 4/1996 | Dorfman et al. |
| 5,518,077 | A | | 5/1996 | Blackman et al. |
| 5,525,134 | A | | 6/1996 | Mehrotra et al. |
| 5,543,235 | A | | 8/1996 | Mirchandani et al. |
| 5,544,550 | A | | 8/1996 | Smith |
| 5,560,440 | A | | 10/1996 | Tibbitts |
| 5,586,612 | A | | 12/1996 | Isbell et al. |
| 5,593,474 | A | | 1/1997 | Keshavan et al. |
| 5,611,251 | A | | 3/1997 | Katayama |
| 5,612,264 | A | | 3/1997 | Nilsson et al. |
| 5,641,251 | A | | 6/1997 | Leins et al. |
| 5,641,921 | A | | 6/1997 | Dennis et al. |
| 5,662,183 | A | | 9/1997 | Fang |
| 5,666,864 | A | | 9/1997 | Tibbitts |
| 5,677,042 | A | | 10/1997 | Massa et al. |
| 5,679,445 | A | | 10/1997 | Massa et al. |
| 5,697,046 | A | | 12/1997 | Conley |
| 5,697,462 | A | | 12/1997 | Grimes et al. |
| 5,732,783 | A | | 3/1998 | Truax et al. |
| 5,733,649 | A | | 3/1998 | Kelley et al. |
| 5,733,664 | A | | 3/1998 | Kelley et al. |
| 5,753,160 | A | | 5/1998 | Takeuchi et al. |
| 5,755,298 | A | | 5/1998 | Langford, Jr. et al. |
| 5,765,095 | A | | 6/1998 | Flak et al. |
| 5,776,593 | A | | 7/1998 | Massa et al. |
| 5,778,301 | A | | 7/1998 | Hong |
| 5,789,686 | A | | 8/1998 | Massa et al. |
| 5,792,403 | A | | 8/1998 | Massa et al. |
| 5,803,152 | A | | 9/1998 | Dolman et al. |
| 5,806,934 | A | | 9/1998 | Massa et al. |
| 5,830,256 | A | | 11/1998 | Northrop et al. |
| 5,856,626 | A | | 1/1999 | Fischer et al. |
| 5,865,571 | A | | 2/1999 | Tankala et al. |
| 5,866,254 | A | | 2/1999 | Peker et al. |
| 5,880,382 | A | | 3/1999 | Fang et al. |
| 5,893,204 | A | | 4/1999 | Symonds |
| 5,897,830 | A | | 4/1999 | Abkowitz et al. |
| 5,899,257 | A | | 5/1999 | Alleweireldt et al. |
| 5,957,006 | A | | 9/1999 | Smith |
| 5,963,775 | A | | 10/1999 | Fang |
| 6,029,544 | A | | 2/2000 | Katayama |
| 6,051,171 | A | | 4/2000 | Takeuchi et al. |
| 6,063,333 | A | | 5/2000 | Dennis |
| 6,068,070 | A | | 5/2000 | Scott |
| 6,073,518 | A | | 6/2000 | Chow et al. |
| 6,086,980 | A | | 7/2000 | Foster et al. |
| 6,089,123 | A | | 7/2000 | Chow et al. |
| 6,109,377 | A | | 8/2000 | Massa et al. |
| 6,109,677 | A | | 8/2000 | Anthony |
| 6,135,218 | A | | 10/2000 | Deane et al. |
| 6,148,936 | A | | 11/2000 | Evans et al. |
| 6,200,514 | B1 | | 3/2001 | Meister |
| 6,209,420 | B1 | | 4/2001 | Butcher et al. |
| 6,214,134 | B1 | | 4/2001 | Eylon et al. |
| 6,214,287 | B1 | | 4/2001 | Waldenstrom |
| 6,220,117 | B1 | | 4/2001 | Butcher |
| 6,227,188 | B1 | | 5/2001 | Tankala et al. |
| 6,228,139 | B1 | | 5/2001 | Oskarsson |
| 6,241,036 | B1 | | 6/2001 | Lovato et al. |
| 6,254,658 | B1 | | 7/2001 | Taniuchi et al. |
| 6,287,360 | B1 | | 9/2001 | Kembaiyan et al. |
| 6,290,438 | B1 | | 9/2001 | Papajewski |
| 6,293,986 | B1 | | 9/2001 | Rodiger et al. |
| 6,302,224 | B1 | | 10/2001 | Sherwood, Jr. |
| 6,353,771 | B1 | | 3/2002 | Southland |
| 6,372,346 | B1 | | 4/2002 | Toth |
| 6,375,706 | B2 | | 4/2002 | Kembaiyan et al. |
| 6,453,899 | B1 | | 9/2002 | Tselesin |
| 6,454,025 | B1 | | 9/2002 | Runquist et al. |
| 6,454,028 | B1 | | 9/2002 | Evans |
| 6,454,030 | B1 | | 9/2002 | Findley et al. |
| 6,458,471 | B2 | | 10/2002 | Lovato et al. |
| 6,474,425 | B1 | | 11/2002 | Truax et al. |
| 6,500,226 | B1 | | 12/2002 | Dennis |
| 6,511,265 | B1 | | 1/2003 | Mirchandani et al. |
| 6,546,991 | B2 | | 4/2003 | Dworog et al. |
| 6,576,182 | B1 | | 6/2003 | Ravagni et al. |
| 6,589,640 | B2 | | 7/2003 | Griffin et al. |
| 6,599,467 | B1 | | 7/2003 | Yamaguchi et al. |
| 6,607,693 | B1 | | 8/2003 | Saito et al. |
| 6,651,757 | B2 | | 11/2003 | Belnap et al. |
| 6,655,481 | B2 | | 12/2003 | Findley et al. |
| 6,655,882 | B2 | | 12/2003 | Heinrich et al. |
| 6,685,880 | B2 | | 2/2004 | Engstrom et al. |
| 6,742,608 | B2 | | 6/2004 | Murdoch |
| 6,742,611 | B1 | | 6/2004 | Illerhaus et al. |
| 6,756,009 | B2 | | 6/2004 | Sim et al. |
| 6,766,870 | B2 | | 7/2004 | Overstreet |
| 6,767,505 | B2 | | 7/2004 | Witherspoon et al. |
| 6,782,958 | B2 | | 8/2004 | Liang et al. |

| | | | |
|---|---|---|---|
| 6,799,648 | B2 | 10/2004 | Brandenberg et al. |
| 6,849,231 | B2 | 2/2005 | Kojima et al. |
| 6,918,942 | B2 | 7/2005 | Hatta et al. |
| 7,044,243 | B2 | 5/2006 | Kembaiyan et al. |
| 7,048,081 | B2 | 5/2006 | Smith et al. |
| 7,250,069 | B2 | 7/2007 | Kembaiyan et al. |
| 7,261,782 | B2 | 8/2007 | Hwang et al. |
| 7,270,679 | B2 | 9/2007 | Istephanous et al. |
| 7,556,668 | B2 | 7/2009 | Eason et al. |
| 7,661,491 | B2 | 2/2010 | Kembaiyan et al. |
| 7,687,156 | B2 | 3/2010 | Fang et al. |
| 7,954,569 | B2 | 6/2011 | Mirchandani et al. |
| 8,020,640 | B2 | 9/2011 | Lockwood et al. |
| 2002/0004105 | A1 | 1/2002 | Kunze et al. |
| 2002/0020564 | A1 | 2/2002 | Fang et al. |
| 2002/0175006 | A1 | 11/2002 | Findley et al. |
| 2003/0010409 | A1 | 1/2003 | Kunze et al. |
| 2003/0041922 | A1 | 3/2003 | Hirose et al. |
| 2003/0219605 | A1 | 11/2003 | Molian et al. |
| 2004/0013558 | A1 | 1/2004 | Kondoh et al. |
| 2004/0060742 | A1 | 4/2004 | Kembaiyan et al. |
| 2004/0149494 | A1 | 8/2004 | Kembaiyan et al. |
| 2004/0196638 | A1 | 10/2004 | Lee et al. |
| 2004/0243241 | A1 | 12/2004 | Istephanous et al. |
| 2004/0244540 | A1 | 12/2004 | Oldham et al. |
| 2004/0245022 | A1 | 12/2004 | Izaguirre et al. |
| 2004/0245024 | A1 | 12/2004 | Kembaiyan |
| 2005/0008524 | A1 | 1/2005 | Testani |
| 2005/0072496 | A1 | 4/2005 | Hwang et al. |
| 2005/0084407 | A1 | 4/2005 | Myrick |
| 2005/0117984 | A1 | 6/2005 | Eason et al. |
| 2005/0126334 | A1 | 6/2005 | Mirchandani |
| 2005/0211475 | A1 | 9/2005 | Mirchandani et al. |
| 2005/0247491 | A1 | 11/2005 | Mirchandani et al. |
| 2005/0268746 | A1 | 12/2005 | Abkowitz et al. |
| 2006/0016521 | A1 | 1/2006 | Hanusiak et al. |
| 2006/0032335 | A1 | 2/2006 | Kembaiyan |
| 2006/0032677 | A1 | 2/2006 | Azar et al. |
| 2006/0043648 | A1 | 3/2006 | Tekeuchi et al. |
| 2006/0057017 | A1 | 3/2006 | Woodfield et al. |
| 2006/0131081 | A1 | 6/2006 | Mirchandani et al. |
| 2007/0042217 | A1 | 2/2007 | Fang et al. |
| 2007/0056777 | A1 | 3/2007 | Overstreet |
| 2007/0102198 | A1 | 5/2007 | Oxford et al. |
| 2007/0102199 | A1 | 5/2007 | Smith et al. |
| 2007/0102200 | A1 | 5/2007 | Choe et al. |
| 2007/0102202 | A1 | 5/2007 | Choe et al. |
| 2007/0151770 | A1 | 7/2007 | Ganz |
| 2007/0193782 | A1 | 8/2007 | Fang et al. |
| 2007/0277651 | A1 | 12/2007 | Calnan et al. |
| 2008/0011519 | A1 | 1/2008 | Smith et al. |
| 2008/0028891 | A1 | 2/2008 | Calnan et al. |
| 2008/0101977 | A1 | 5/2008 | Eason et al. |
| 2008/0163723 | A1 | 7/2008 | Mirchandani et al. |
| 2008/0302576 | A1 | 12/2008 | Mirchandani et al. |
| 2009/0301788 | A1 | 12/2009 | Stevens et al. |
| 2010/0193252 | A1 | 8/2010 | Mirchandani et al. |
| 2011/0284179 | A1 | 11/2011 | Stevens et al. |
| 2011/0287238 | A1 | 11/2011 | Stevens et al. |
| 2011/0287924 | A1 | 11/2011 | Stevens |

FOREIGN PATENT DOCUMENTS

| | | | |
|---|---|---|---|
| EP | 0264674 | A2 | 4/1988 |
| EP | 0453428 | A1 | 10/1991 |
| EP | 0995876 | A2 | 4/2000 |
| EP | 1244531 | B1 | 10/2002 |
| GB | 945227 | | 12/1963 |
| GB | 2315452 | | 2/1998 |
| GB | 2384745 | | 8/2003 |
| GB | 2385350 | A | 8/2003 |
| GB | 2393449 | A | 3/2004 |
| JP | 5064288 | | 8/1993 |
| JP | 10219385 | A | 8/1998 |
| UA | 6742 | | 12/1994 |
| UA | 63469 | | 1/2006 |
| UA | 23749 | | 11/2007 |
| WO | 03049889 | A2 | 6/2003 |
| WO | 2004053197 | A2 | 6/2004 |
| WO | 2007127899 | | 11/2007 |

OTHER PUBLICATIONS

International Search Report and Written Opinion for PCT/US2005/014742, completed Jul. 25, 2005.

International Preliminary Report on Patentability for PCT/US2005/014742,dated Nov. 1, 2006.

Sims et al., Superalloys II, Casting Engineering, Aug. 1987, pp. 420-426.

Sikkenga, Cobalt and Cobalt Alloy Castings, Casting, vol. 15, ASM Handbook, ASM International, 2008, pp. 1114-1118.

Pyrotek, Zyp Zircwash, www.pyrotek.info, no date, 1 page.

Starck, H.C., Surface Technology, Powders for PTA-Welding, Lasercladding and other Wear Protective Welding Applications, AMPERWELD, 4 pages.

Amperweld, Surface Technology, Powders for PTA-Welding, Lasercladding and other Wear Protective Welding Applications, H.C. Starck Empowering High Tech Materials, 4 pages.

* cited by examiner

EARTH-BORING TOOLS AND COMPONENTS THEREOF INCLUDING MATERIAL HAVING HARD PHASE IN A METALLIC BINDER, AND METALLIC BINDER COMPOSITIONS FOR USE IN FORMING SUCH TOOLS AND COMPONENTS

CROSS-REFERENCE TO RELATED APPLICATIONS

This application is a divisional of U.S. patent application Ser. No. 12/192,292, filed Aug. 15, 2008, now U.S. Pat. No. 8,172,914, issued May 8, 2012,which application is a divisional of U.S. patent application Ser. No. 10/848,437, filed May 18, 2004, abandoned, which application is a nonprovisional application claiming priority from U.S. Provisional Application Ser. No. 60/566,063 filed on Apr. 28, 2004, the entire disclosure of each of which is hereby incorporated herein by this reference. The subject matter of this application is also related to the subject matter of U.S. patent application Ser. No. 12/763,968, filed Apr. 20, 2010, now U.S. Pat. No. 8,087,324, issued Jan. 3, 2012; U.S. patent application Ser. No. 12/033,960, filed Feb. 20, 2008, now U.S. Pat. No. 8,007,714 issued Aug. 30, 2011; U.S. patent application Ser. No. 11/932,027, filed Oct. 31, 2007, now abandoned; and U.S. patent application Ser. No. 11/116,752, filed Apr. 28, 2005, now U.S. Pat. No. 7,954,569, issued Jun. 7, 2011.

TECHNICAL FIELD

This invention relates to improvements to earth-boring bits and methods of producing earth-boring bits. More specifically, the invention relates to earth-boring bit bodies, roller cones, and teeth for roller cone earth-boring bits and methods of forming earth-boring bit bodies, roller cones, and teeth for roller cone earth-boring bits.

BACKGROUND

Earth-boring bits may have fixed or rotatable cutting elements. Earth-boring bits with fixed cutting elements typically include a bit body machined from steel or fabricated by infiltrating a bed of hard particles, such as cast carbide (WC+$W_2C$), macrocrystalline or standard tungsten carbide (WC), and/or sintered cemented carbide with a binder such as, for example, a copper-based alloy. Several cutting inserts are fixed to the bit body in predetermined positions to optimize cutting. The bit body may be secured to a steel shank that typically includes a threaded pin connection by which the bit is secured to a drive shaft of a downhole motor or a drill collar at the distal end of a drill string.

Steel-bodied bits are typically machined from round stock to a desired shape, with topographical and internal features. Hardfacing techniques may be used to apply wear-resistant materials to the face of the bit body and other critical areas of the surface of the bit body.

In the conventional method for manufacturing a bit body from hard particles and a binder, a mold is milled or machined to define the exterior surface features of the bit body. Additional hand milling or clay work may also be required to create or refine topographical features of the bit body.

Once the mold is complete, a preformed bit blank of steel may be disposed within the mold cavity to internally reinforce the bit body matrix upon fabrication. Other transition or refractory metal-based inserts, such as those defining internal fluid courses, pockets for cutting elements, ridges, lands, nozzle displacements, junk slots, or other internal or topographical features of the bit body, may also be inserted into the cavity of the mold. Any inserts used must be placed at precise locations to ensure proper positioning of cutting elements, nozzles, junk slots, etc., in the final bit.

The desired hard particles may then be placed within the mold and packed to the desired density. The hard particles are then infiltrated with a molten binder, which freezes to form a solid bit body including a discontinuous phase of hard particles within a continuous phase of the binder.

The bit body may then be assembled with other earth-boring bit components. For example, a threaded shank may be welded or otherwise secured to the bit body, and cutting elements or inserts (typically diamond or a synthetic polycrystalline diamond compact ("PDC")) are secured within the cutting insert pockets, such as by brazing, adhesive bonding, or mechanical affixation. Alternatively, the cutting inserts may be bonded to the face of the bit body during furnacing and infiltration if thermally stable PDCs ("TSP") are employed.

Rotatable earth-boring bits for oil and gas exploration conventionally comprise cemented carbide cutting inserts attached to conical holders that form part of a roller-cone assembled bit. The bit body of the roller cone bit is usually made of alloy steel.

Earth-boring bits typically are secured to the terminal end of a drill string, which is rotated from the surface. Drilling fluid or mud is pumped down the hollow drill string and out nozzles formed in the bit body. The drilling fluid or mud cools and lubricates the bit as it rotates and also carries material cut by the bit to the surface.

The bit body and other elements of earth-boring bits are subjected to many forms of wear as they operate in the harsh downhole environment. Among the most common form of wear is abrasive wear caused by contact with abrasive rock formations. In addition, the drilling mud, laden with rock cuttings, causes the bit to erode or wear.

The service life of an earth-boring bit is a function not only of the wear properties of the PDCs or cemented carbide inserts, but also of the wear properties of the bit body (in the case of fixed cutter bits) or conical holders (in the case of roller cone bits). One way to increase earth-boring bit service life is to employ bit bodies or conical holders made of materials with improved combinations of strength, toughness, and abrasion/erosion resistance.

Accordingly, there is a need for improved bit bodies for earth-boring bits having increased wear resistance, strength and toughness.

SUMMARY OF THE INVENTION

The present invention relates to a composition for forming a bit body for an earth-boring bit. The bit body comprises (i) hard particles, wherein the hard particles comprise at least one of carbides, nitrides, borides, silicides and oxides and solid solutions thereof and (ii) a binder binding together the hard particles. The hard particles may comprise at least one transition metal carbide selected from carbides of titanium, chromium, vanadium, zirconium, hafnium, tantalum, molybdenum, niobium, and tungsten or solid solutions thereof. The hard particles may be present as individual or mixed carbides and/or as sintered cemented carbides. Embodiments of the binder may comprise (i) at least one metal selected from cobalt, nickel, and iron, (ii) at least one melting point-reducing constituent selected from a transition metal carbide up to 60 weight percent, up to 50 weight percent of one or more of the transition elements, carbon up to 5 weight percent, boron up to 10 weight percent, silicon up to 20 weight percent, chromium up to 20 weight percent, and manganese up to 25 weight percent, wherein the weight percentages are based on the total weight of the binder. In one embodiment, the binder comprises 40 to 50 weight percent of tungsten carbide and 40 to 60 weight percent of at least one of iron, cobalt, and nickel. For the purpose of this invention, transition elements are defined as those belonging to groups IVB, VB, and VIB of the periodic table.

Another embodiment of the composition for forming a matrix body comprises hard particles and a binder, wherein the binder has a melting point in the range of 1050° C. to 1350° C. The binder may be an alloy comprising at least one of iron, cobalt, and nickel and may further comprise at least one of a transition metal carbide, a transition element, carbon, boron, silicon, chromium, manganese, silver, aluminum, copper, tin, and zinc. More preferably, the binder may be an alloy comprising at least one of iron, cobalt, and nickel and at least one of a tungsten carbide, tungsten, carbon, boron, silicon, chromium, and manganese.

A further embodiment of the invention is a composition for forming a matrix body, the composition comprising hard particles of a transition metal carbide and a binder comprising at least one of nickel, iron, and cobalt and having a melting point less than 1350° C. The binder may further comprise at least one of a transition metal carbide, tungsten carbide, tungsten, carbon, boron, silicon, chromium, manganese, silver, aluminum, copper, tin, and zinc.

In the manufacture of bit bodies, hard particles and, optionally, inserts may be placed within a bit body mold. The hard particles (and any inserts present) may then be infiltrated with a molten binder, which freezes to form a solid matrix body including a discontinuous phase of hard particles within a continuous phase of binder. Embodiments of the present invention also include methods of forming articles, such as, but not limited to, bit bodies for earth-boring bits, roller cones, and teeth for rolling cone drill bits. An embodiment of the method of forming an article may comprise infiltrating a mass of hard particles comprising at least one transition metal carbide with a binder comprising at least one of nickel, iron, and cobalt and having a melting point less than 1350° C. Another embodiment includes a method comprising infiltrating a mass of hard particles comprising at least one transition metal carbide with a binder having a melting point in the range of 1050° C. to 1350° C. The binder may comprise at least one of iron, nickel, and cobalt, wherein the total concentration of iron, nickel, and cobalt is from 40 to 99 weight percent by weight of the binder. The binder may further comprise at least one of a selected transition metal carbide, tungsten carbide, tungsten, carbon, boron, silicon, chromium, manganese, silver, aluminum, copper, tin, and zinc in a concentration effective to reduce the melting point of the iron, nickel, and/or cobalt. The binder may be a eutectic or near-eutectic mixture. The lowered melting point of the binder facilitates proper infiltration of the mass of hard particles.

A further embodiment of the invention is a method of producing an earth-boring bit, comprising casting the earth-boring bit from a molten mixture of at least one of iron, nickel, and cobalt and a carbide of a transition metal. The mixture may be a eutectic or near eutectic mixture. In these embodiments, the earth-boring bit may be cast directly without infiltrating a mass of hard particles.

Unless otherwise indicated, all numbers expressing quantities of ingredients, time, temperatures, and so forth used in the present specification and claims are to be understood as being modified in all instances by the term "about." Accordingly, unless indicated to the contrary, the numerical parameters set forth in the following specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, may inherently contain certain errors necessarily resulting from the standard deviation found in their respective testing measurements.

The reader will appreciate the foregoing details and advantages of the present invention, as well as others, upon consideration of the following detailed description of embodiments of the invention. The reader also may comprehend such additional details and advantages of the present invention upon making and/or using embodiments within the present invention.

BRIEF DESCRIPTION OF THE FIGURES

The features and advantages of the present invention may be better understood by reference to the accompanying figures in which.

DESCRIPTION OF THE INVENTION

Embodiments of the present invention relate to a composition for the formation of bit bodies for earth-boring bits, roller cones, and teeth for roller cone drill bits and methods of making a bit body for an earth-boring bit, roller cones, and teeth for roller cone drill bits. Additionally, the method may be used to make other articles. Certain embodiments of a bit body of the present invention comprise at least one discontinuous hard phase and a continuous binder phase binding together the hard phase. Embodiments of the compositions and methods of the present invention provide increased service life for the bit body, teeth, and roller cones produced from the composition and method and thereby improve the service life of the earth-boring bit.

Figure 1:
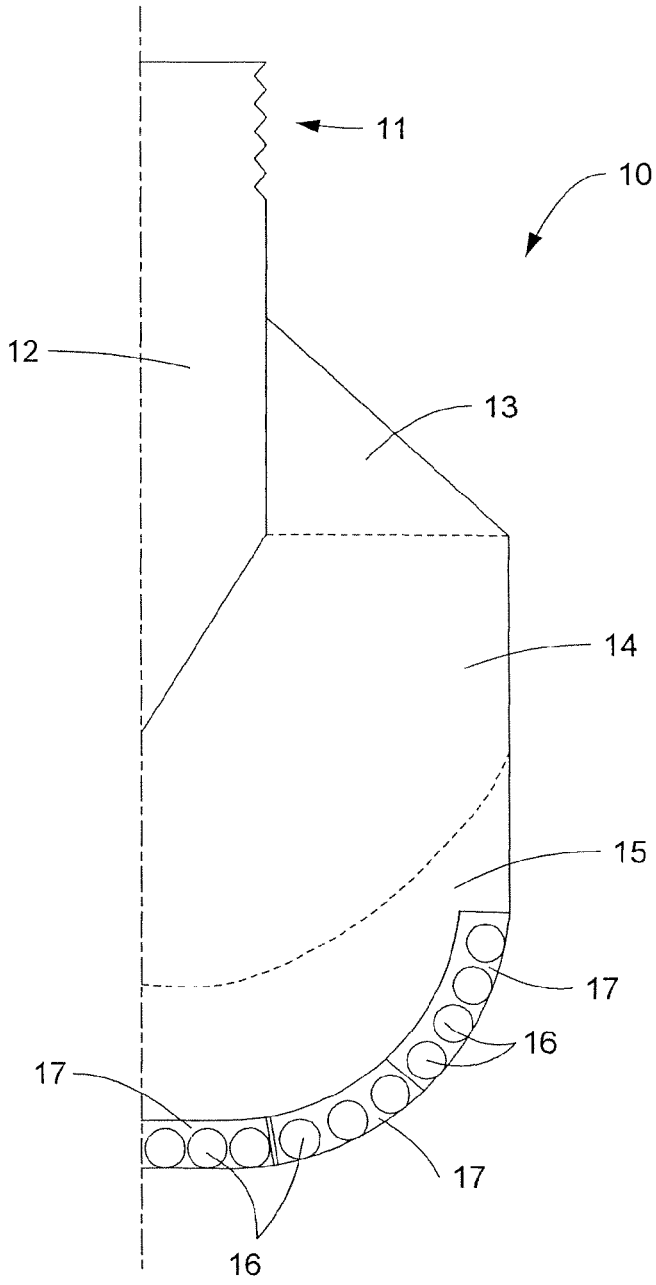
FIG. 1 is a schematic cross-sectional view of an embodiment of a bit body for an earth-boring bit.

A typical bit body 10 of an earth-boring bit is shown in FIG. 1. Generally, a bit body 10 comprises attachment means 11 on a shank 12 incorporated in the bit body 10. The shank 12 is typically made of steel. A bit body may be constructed having various sections, and each section may be comprised of a different concentration, composition, and size of hard particles, for example. The example bit body 10 of FIG. 1 comprises three sections. The top section 13 may comprise a discontinuous hard phase of tungsten and/or tungsten carbide, the mid-section 14 may comprise a discontinuous hard phase of coarse cast tungsten carbide ($W_2C$, WC), tungsten carbide, and/or sintered cemented carbide particles, and the bottom section 15, if present, may comprise a discontinuous hard phase of fine cast carbide, tungsten carbide, and/or sintered cemented carbide particles. The bit body 10 also includes pockets 16 along the bottom of the bit body 10 and into which cutting inserts may be disposed. The bit body 10 may also include internal fluid courses, ridges, lands, nozzle displacements, junk slots, and any other conventional topographical features of an earth-boring bit body. Optionally, these topographical features may be defined by preformed inserts, such as inserts 17, that are dispersed at suitable positions on the bit body. Embodiments of the present invention include bit bodies comprising inserts produced from cemented carbides. In a conventional bit body, the hard-phase particles are bound in a matrix of copper-based alloy, such as brasses or bronzes. Embodiments of the bit body of the present invention may comprise or be fabricated with novel binders to import improved wear resistance, strength and toughness to the bit body.

In certain embodiments, the binder used to fabricate the bit body has a melting temperature between 1050° C. and 1350° C. In other embodiments, the binder comprises an alloy of at least one of cobalt, iron, and nickel, wherein the alloy has a melting point of less than 1350° C. In other embodiments of the composition of the present invention, the composition comprises at least one of cobalt, nickel, and iron and a melting point-reducing constituent. Pure cobalt, nickel, and iron are characterized by high melting points (approximately 1500° C.), and hence the infiltration of beds of hard particles by pure molten cobalt, iron, or nickel is difficult to accomplish in a practical manner without formation of excessive porosity. However, an alloy of at least one of cobalt, iron, or nickel may be used if it includes a sufficient amount of at least one melting point-reducing constituent. The melting point-reducing constituent may be at least one of a transition metal carbide, a transition element, tungsten, carbon, boron, silicon, chromium, manganese, silver, aluminum, copper, tin, zinc, as well as other elements that alone or in combination can be added in amounts that reduce the melting point of the binder sufficiently so that the binder may be used effectively to form a bit body by the selected method. A binder may effectively be used to form a bit body if the binder's properties, for example, melting point, molten viscosity, and infiltration distance, are such that the bit body may be cast without an excessive amount of porosity. Preferably, the melting point-reducing constituent is at least one of a transition metal carbide, a transition metal, tungsten, carbon, boron, silicon, chromium and manganese. It may be preferable to combine two or more of the above melting point-reducing constituents to obtain a binder effective for infiltrating a mass of hard particles. For example, tungsten and carbon may be added together to produce a greater melting point reduction than produced by the addition of tungsten alone and, in such a case, the tungsten and carbon may be added in the form of tungsten carbide. Other melting point-reducing constituents may be added in a similar manner.

The one or more melting point-reducing constituents may be added alone or in combination with other binder constituents in any amount that produces a binder composition effective for producing a bit body. In addition, the one or more melting point-reducing constituents may be added such that the binder is a eutectic or near eutectic composition. Providing a binder with eutectic or near-eutectic concentration of ingredients ensures that the binder will have a lower melting point, which may facilitate casting and infiltrating the bed of hard particles. In certain embodiments, it is preferable for the one or more melting point-reducing constituents to be present in the binder in the following weight percentages based on the total binder weight: tungsten may be present up to 55%, carbon may be present up to 4%, boron may be present up to 10%, silicon may be present up to 20%, chromium may be present up to 20%, and manganese may be present up to 25%. In certain other embodiments, it may be preferable for the one or more melting point-reducing constituents to be present in the binder in one or more of the following weight percentages based on the total binder weight: tungsten may be present from 30 to 55%, carbon may be present from 1.5 to 4%, boron may be present from 1 to 10%, silicon may be present from 2 to 20%, chromium may be present from 2 to 20%, and manganese may be present from 10 to 25%. In certain other embodiments of the composition of the present invention, the melting point-reducing constituent may be tungsten carbide present from 30 to 60 weight %. Under certain casting conditions and binder concentrations, all or a portion of the tungsten carbide will precipitate from the binder upon freezing and will form a hard phase. This precipitated hard phase may be in addition to any hard phase present as hard particles in the mold. However, if no hard particles are disposed in the mold or in a section of the mold, all the hard-phase particles in the bit body or in the section of the bit body may be formed as tungsten carbide precipitated during casting.

Embodiments of the present invention also comprise bit bodies for earth-boring bits comprising transition metal carbide, wherein the bit body comprises a volume fraction of tungsten carbide greater than 75 volume %. It is now possible to prepare bit bodies having such a volume fraction of, for example, tungsten carbide due to the method of the present invention, embodiments of which are described below. An embodiment of the method comprises infiltrating a bed of tungsten carbide hard particles with a binder that is a eutectic or near eutectic composition of at least one of cobalt, iron, and nickel and tungsten carbide. It is believed that bit bodies comprising concentrations of discontinuous-phase tungsten carbide of up to 95% by volume may be produced by methods of the present invention if a bed of tungsten is infiltrated with a molten eutectic or near eutectic composition of tungsten carbide and at least one of cobalt, iron, and nickel. In contrast, conventional infiltration methods for producing bit bodies may only be used to produce bit bodies having a maximum of about 72% by volume tungsten carbide. The inventors have determined that the volume concentration of tungsten carbide in the cast bit body can be 75% up to 95% if using as infiltrated, a eutectic or near eutectic composition of tungsten carbide and at least one of cobalt, iron, and nickel. Presently, there are limitations in the volume percentage of hard phase that may be formed in a bit body due to limitations in the packing density of a mold with hard particles and the difficulties in infiltrating a densely packed mass of hard particles. However, precipitating carbide from an infiltrant binder comprising a eutectic or near eutectic composition avoids these difficulties. Upon freezing of the binder in the bit body mold, the additional hard phase is formed by precipitation from the molten infiltrant during cooling. Therefore, a greater concentration of hard phase is formed in the bit body than could be achieved if the molten binder lacks dissolved tungsten carbide. Use of molten binder/infiltrant compositions at or near the eutectic allows higher volume percentages of hard phase in bit bodies than previously available.

The volume percent of tungsten carbide in the bit body may be additionally increased by incorporating cemented carbide inserts into the bit body. The cemented carbide inserts may be used for forming internal fluid courses, pockets for cutting elements, ridges, lands, nozzle displacements, junk slots, or other topographical features of the bit body, or merely to provide structural support, stiffness, toughness, strength, or wear resistance at selected locations with the body or holder. Conventional cemented carbide inserts may comprise from 70 to 99 volume % of tungsten carbide if prepared by conventional cemented carbide techniques. Any known cemented carbide may be used as inserts in the bit body, such as, but not limited to, composites of carbides of at least one of titanium, zirconium, hafnium, vanadium, niobium, tantalum, chromium, molybdenum and tungsten in a binder of at least one of cobalt, iron, and nickel. Additional alloying agents may be present in the cemented carbides as are known in the art.

Embodiments of the composition for forming a bit body also comprise at least one hard particle type. As stated above, the bit body may also comprise various regions comprising different types and/or concentrations of hard particles. For example, bit body 10 of FIG. 1 may comprise a bottom section 15 of a harder wear-resistant discontinuous hard-phase material with a fine particle size and a mid-section 14 of a tougher discontinuous hard-phase material with a relatively coarse particle size. The hard phase of any section may comprise at least one of carbide, nitride, boride, oxide, cast carbide, cemented carbide, mixtures thereof, and solid solutions thereof. In certain embodiments, the hard phase may comprise at least one cemented carbide comprising at least one of titanium, zirconium, hafnium, vanadium, niobium, tantalum, chromium, molybdenum, and tungsten. The cemented carbides may have any suitable particle size or shape, such as, but not limited to, irregular, spherical, oblate and prolate shapes.

Certain embodiments of the composition of the present invention may comprise from 30 to 95 volume % of hard phase and from 5 to 70 volume % of binder phase. Isolated regions of the bit body may be within a broader range of hard-phase concentrations from, for example, 30 to 99 volume % hard phase. This may be accomplished, for example, by disposing hard particles in various packing densities in certain locations within the mold or by placing cemented carbide inserts in the mold prior to casting the bit body or other article. Additionally, the bit body may be formed by casting more than one binder into the mold.

A difficulty with fabricating a bit body or holder comprising a binder including at least one of cobalt, iron, and nickel stems from the relatively high melting points of cobalt, iron, and nickel. The melting point of each of these metals at atmospheric pressure is approximately 1500° C. In addition, since cobalt, iron, and nickel have high solubilities in the liquid state for tungsten carbide, it is difficult to prevent premature freezing of, for example, a molten cobalt-tungsten or nickel-tungsten carbide alloy while attempting to infiltrate a bed of tungsten carbide particles when casting an earth-boring bit body. This phenomenon may lead to the formation of pin-holes in the casting, even with the use of high temperatures, such as greater than 1400° C., during the infiltration process.

Embodiments of the method of the present invention may overcome the difficulties associated with cobalt-, iron- and nickel-infiltrated cast composites by use of a prealloyed cobalt-tungsten carbide eutectic or near eutectic composition (30 to 60% tungsten carbide and 40 to 70% cobalt, by weight). For example, a cobalt alloy having a concentration of approximately 43 weight % of tungsten carbide has a melting point of approximately 1300° C. (see FIG. 2). The lower melting point of the eutectic or near-eutectic alloy relative to cobalt, iron, and nickel, along with the negligible freezing range of the eutectic or near eutectic composition, can greatly facilitate the fabrication of cobalt-tungsten carbide-based diamond bit bodies, as well as cemented carbide conical holders and roller cone bits. In the solid state, such eutectic or near eutectic alloys are essentially composites containing two phases, namely, tungsten carbide (a hard discontinuous phase) and cobalt (a ductile continuous phase or binder phase). Eutectic or near-eutectic mixtures of cobalt-tungsten carbide, nickel-tungsten carbide, cobalt-nickel-tungsten carbide and iron-tungsten carbide alloys, for example, can be expected to exhibit far higher strength and toughness levels compared with brass- and bronze-based composites at equivalent abrasion/erosion resistance levels. These alloys can also be expected to be machinable using conventional cutting tools.

Certain embodiments of the method of the invention comprise infiltrating a mass of hard particles with a binder that is a eutectic or near eutectic composition comprising at least one of cobalt, iron, and nickel and tungsten carbide, and wherein the binder has a melting point less than 1350° C. As used herein, a near eutectic concentration means that the concentrations of the major constituents of the composition are within 10 weight % of the eutectic concentrations of the constituents. The eutectic concentration of tungsten carbide in cobalt is approximately 43 weight percent. Eutectic compositions are known or easily approximated by one skilled in the art. Casting the eutectic or near eutectic composition may be performed with or without hard particles in the mold. However, it may be preferable that upon solidification, the composition fauns a precipitated hard tungsten carbide phase and a binder phase. The binder may further comprise alloying agents, such as at least one of boron, silicon, chromium, manganese, silver, aluminum, copper, tin, and zinc.

Embodiments of the present invention may comprise as one aspect the fabrication of bodies and conical holders from eutectic or near-eutectic compositions employing several different methods. Examples of these methods include:

1. Infiltrating a bed or mass of hard particles comprising a mixture of transition metal carbide particles and at least one of cobalt, iron, and nickel (i.e., a cemented carbide) with a molten infiltrant that is a eutectic or near eutectic composition of a carbide and at least one of cobalt, iron, and nickel.

2. Infiltrating a bed or mass of transition metal carbide particles with a molten infiltrant that is a eutectic or near eutectic composition of a carbide and at least one of cobalt, iron, and nickel.

3. Casting a molten eutectic or near eutectic composition of a carbide, such as tungsten carbide, and at least one of cobalt, iron, and nickel to a net-shape or a near-net-shape in the form of a bit body, roller cone, or conical holder.

4. Mixing powdered binder and hard particles together, placing the mixture in a mold, heating the powders to a temperature greater than the melting point of the binder, and cooling to cast the materials into the form of an earth-boring bit body, a roller cone, or a conical holder. This so-called "casting in place" method may allow the use of binders with relatively less capacity for infiltrating a mass of hard particles since the binder is mixed with the hard particles prior to melting and, therefore, shorter infiltration distances are required to form the article.

In certain methods of the present invention, infiltrating the hard particles may include loading a funnel with a binder, melting the binder, and introducing the binder into the mold with the hard particles and, optionally, the inserts. The binder, as discussed above, may be a eutectic or near eutectic composition or may comprise at least one of cobalt, iron, and nickel and at least one melting point-reducing constituent.

Another method of the present invention comprises preparing a mold and casting a eutectic or near eutectic mixture of at least one of cobalt, iron, and nickel and a hard-phase component. As the eutectic mixture cools, the hard phase may precipitate from the mixture to faun the hard phase. This method may be useful for the formation of roller cones and teeth in tri-cone drill bits.

Another embodiment of the present invention involves casting in place, mentioned above. An example of this embodiment comprises preparing a mold, adding a mixture of hard particles and binder to the mold, and heating the mold above the melting temperature of the binder. This method results in the casting in place of the bit body, roller cone, and teeth for tri-cone drill bits. This method may be preferable when the expected infiltration distance of the binder is not sufficient for sufficiently infiltrating the hard particles conventionally.

The hard particles or hard phase may comprise one or more of carbides, oxides, borides, and nitrides, and the binder phase may be composed of the one or more of the Group VIII metals, namely, Co, Ni, and/or Fe. The morphology of the hard phase can be in the form of irregular, equiaxed, or spherical particles, fibers, whiskers, platelets, prisms, or any other useful form. In certain embodiments, the cobalt, iron, and nickel alloys useful in this invention can contain additives, such as boron, chromium, silicon, aluminum, copper, manganese, or ruthenium, in total amounts up to 20 weight % of the ductile continuous phase.

Figure 2:
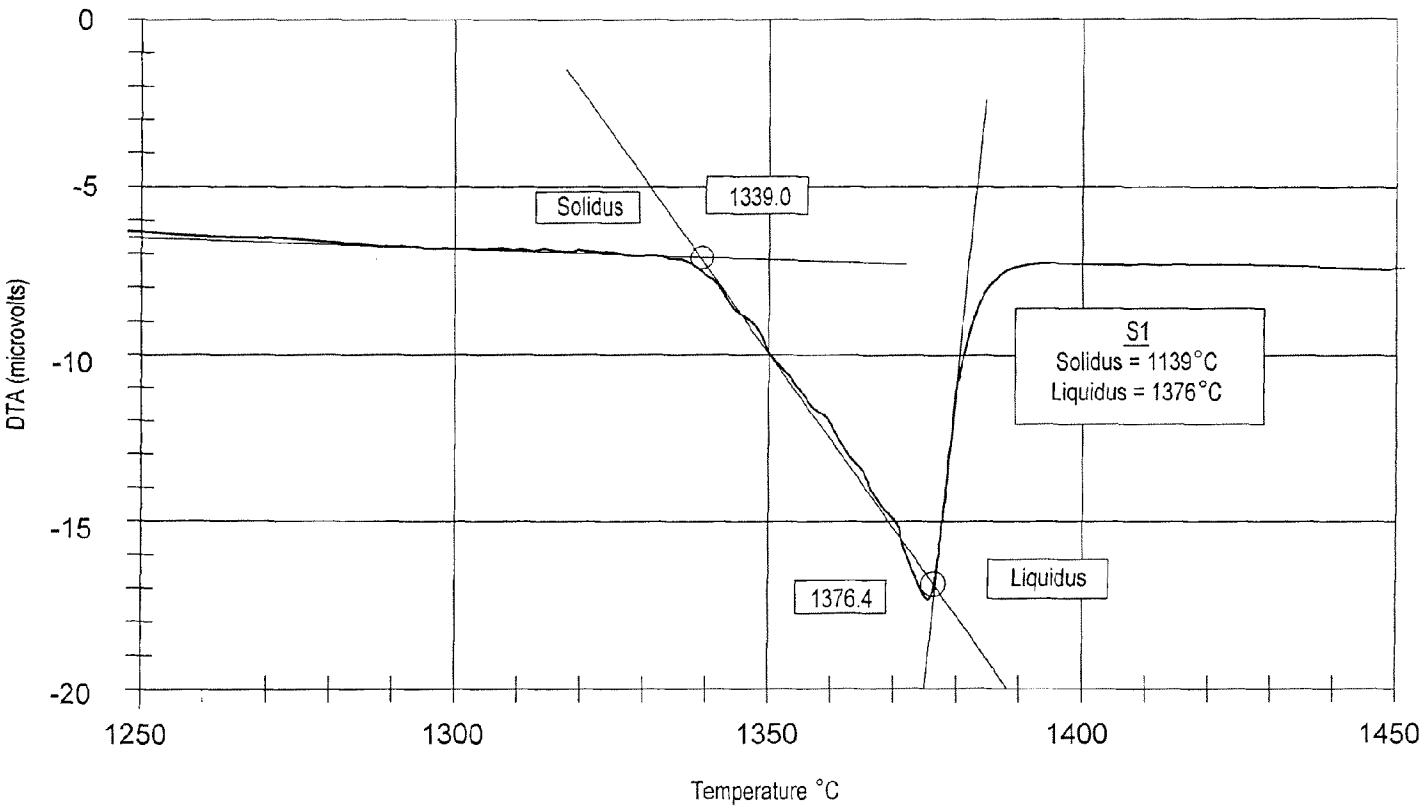
FIG. 2 is a graph of the results of a two-cycle DTA, from 900° C. to 1400° C. at a rate of temperature increase of 10° C./minute in an argon atmosphere, of a sample comprising about 45% tungsten carbide and about 55% cobalt.

FIGS. 2 to 8 are graphs of the results of Differential Thermal Analysis (DTA) on embodiments of the binders of the present invention. FIG. 2 is a graph of the results of a two-cycle DTA, from 900° C. to 1400° C. at a rate of temperature increase of 10° C./minute in an argon atmosphere, of a sample comprising about 45% tungsten carbide and about 55% cobalt (all percentages are in weight percent unless noted otherwise). The graph shows the melting point of the alloy to be approximately 1339° C.

Figure 3:
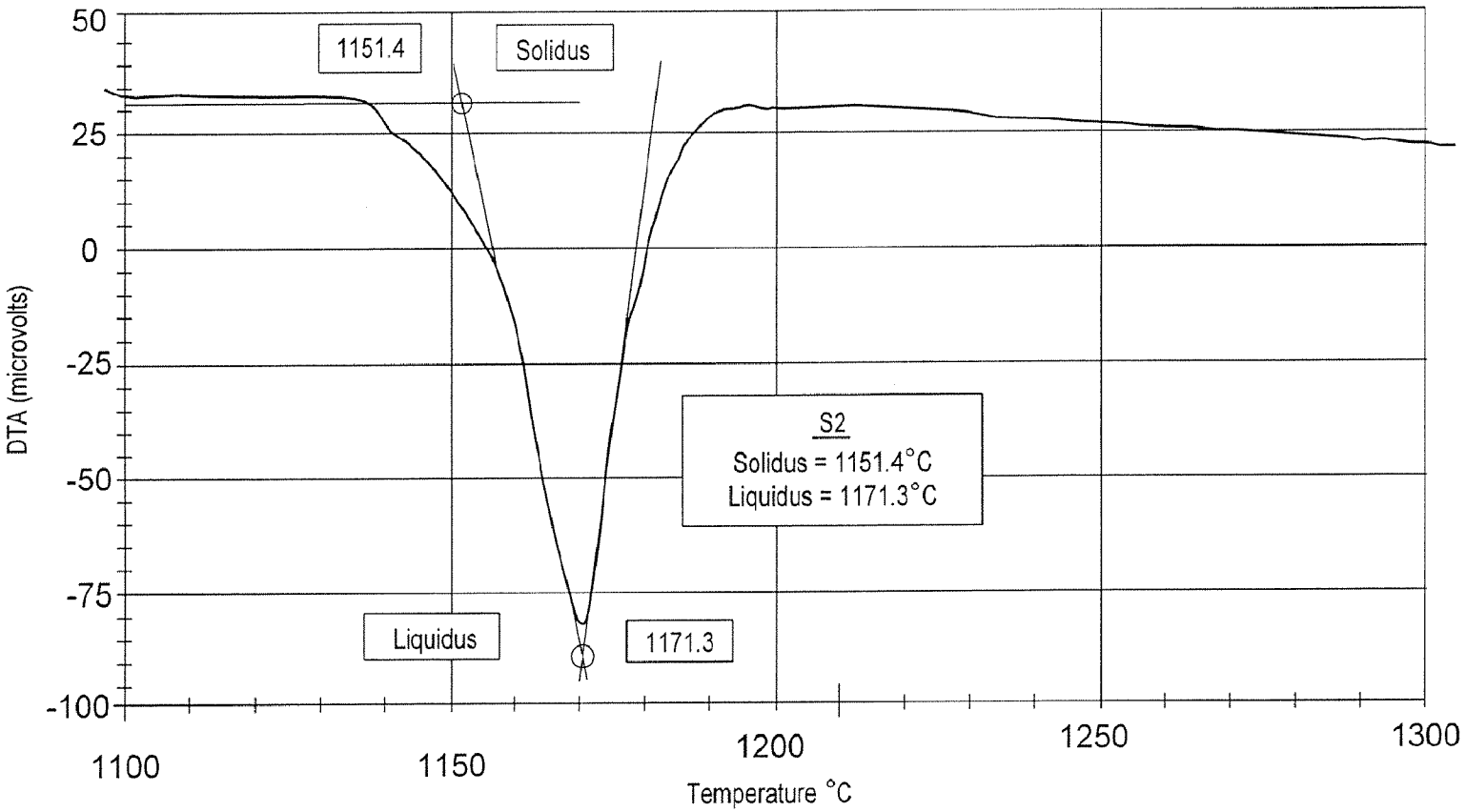
FIG. 3 is a graph of the results of a two-cycle DTA, from 900° C. to 1300° C. at a rate of temperature increase of 10° C./minute in an argon atmosphere, of a sample comprising about 45% tungsten carbide, about 53% cobalt, and about 2% boron.

FIG. 3 is a graph of the results of a two-cycle DTA, from 900° C. to 1300° C. at a rate of temperature increase of 10° C./minute in an argon atmosphere, of a sample comprising about 45% tungsten carbide, about 53% cobalt, and about 2% boron. The graph shows the melting point of the alloy to be approximately 1151° C. As compared to the DTA of the alloy of FIG. 2, the replacement of about 2% of cobalt with boron reduced the melting point of the alloy in FIG. 3 almost 200° C.

Figure 4:
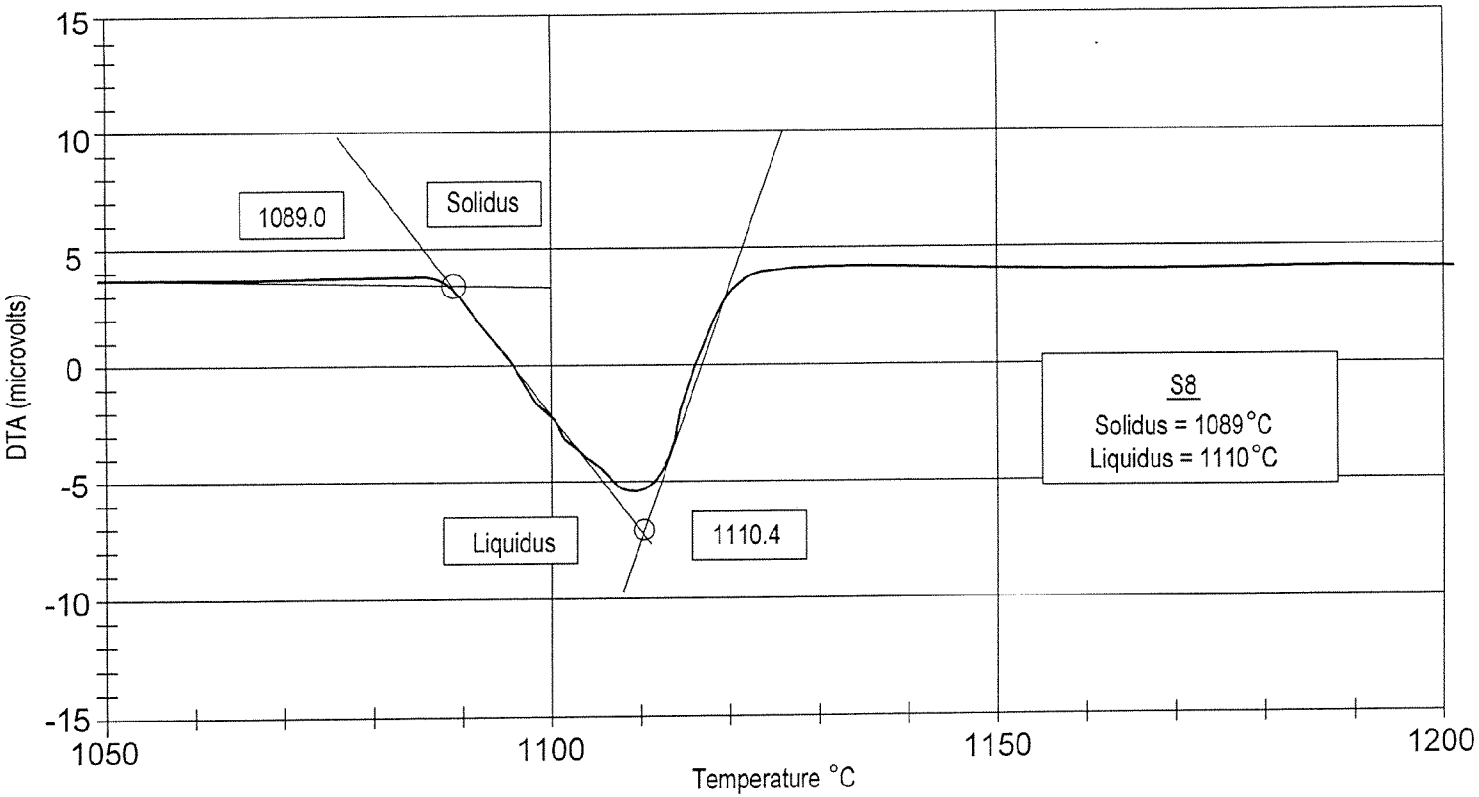
FIG. 4 is a graph of the results of a two-cycle DTA, from 900° C. to 1400° C. at a rate of temperature increase of 10° C./minute in an argon atmosphere, of a sample comprising about 45% tungsten carbide, about 53% nickel, and about 2% boron.

FIG. 4 is a graph of the results of a two-cycle DTA, from 900° C. to 1400° C. at a rate of temperature increase of 10° C./minute in an argon atmosphere, of a sample comprising about 45% tungsten carbide, about 53% nickel, and about 2% boron. The graph shows the melting point of the alloy to be approximately 1089° C. As compared to the DTA of the alloy of FIG. 3, the replacement of cobalt with nickel reduced the melting point of the alloy in FIG. 4 almost 60° C.

Figure 5:
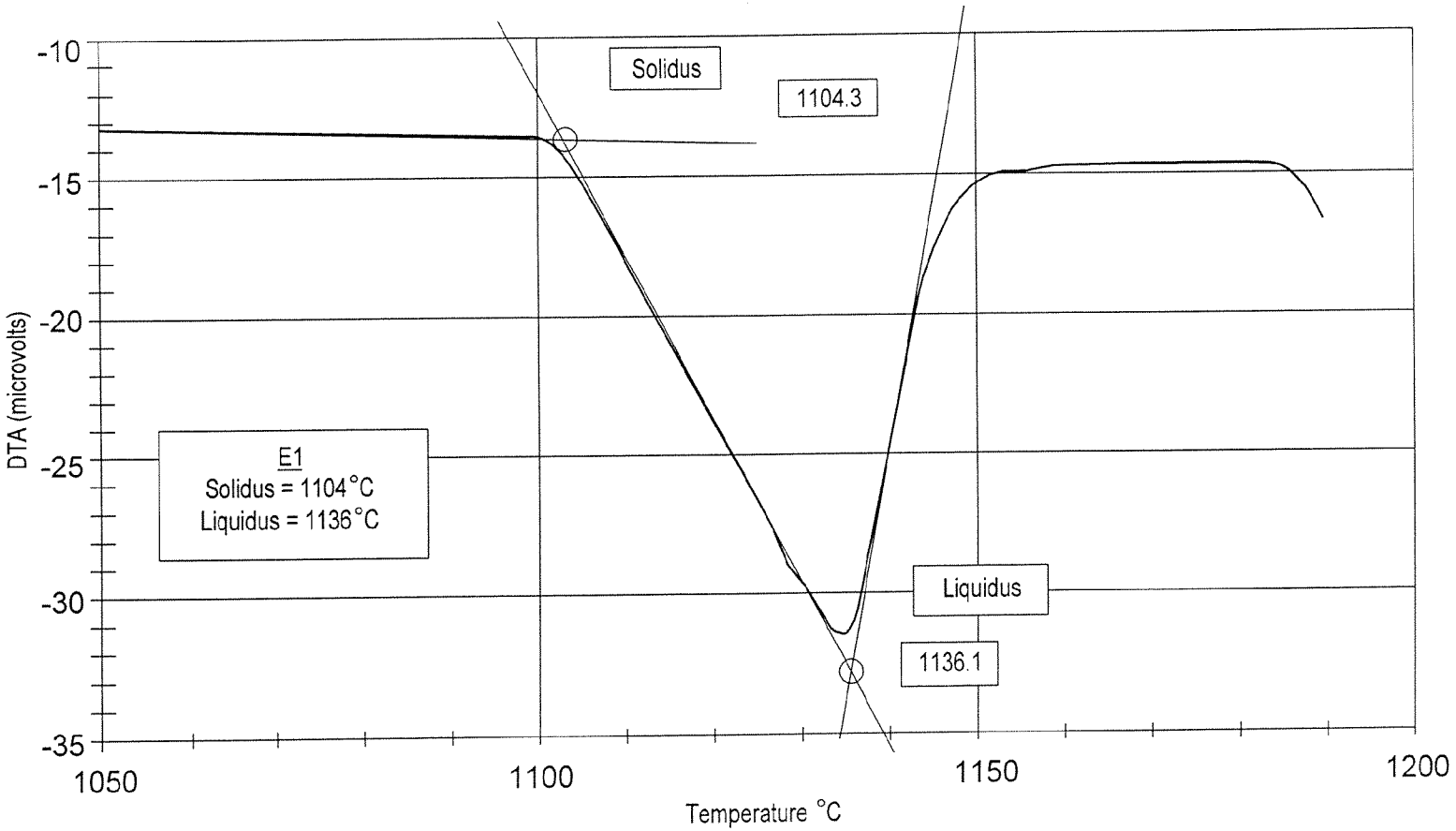
FIG. 5 is a graph of the results of a two-cycle DTA, from 900° C. to 1200° C. at a rate of temperature increase of 10° C./minute in an argon atmosphere, of a sample comprising about 96.3% nickel and about 3.7% boron.

FIG. 5 is a graph of the results of a two-cycle DTA, from 900° C. to 1200° C. at a rate of temperature increase of 10° C./minute in an argon atmosphere, of a sample comprising about 96.3% nickel and about 3.7% boron. The graph shows the melting point of the alloy to be approximately 1100° C.

Figure 6:
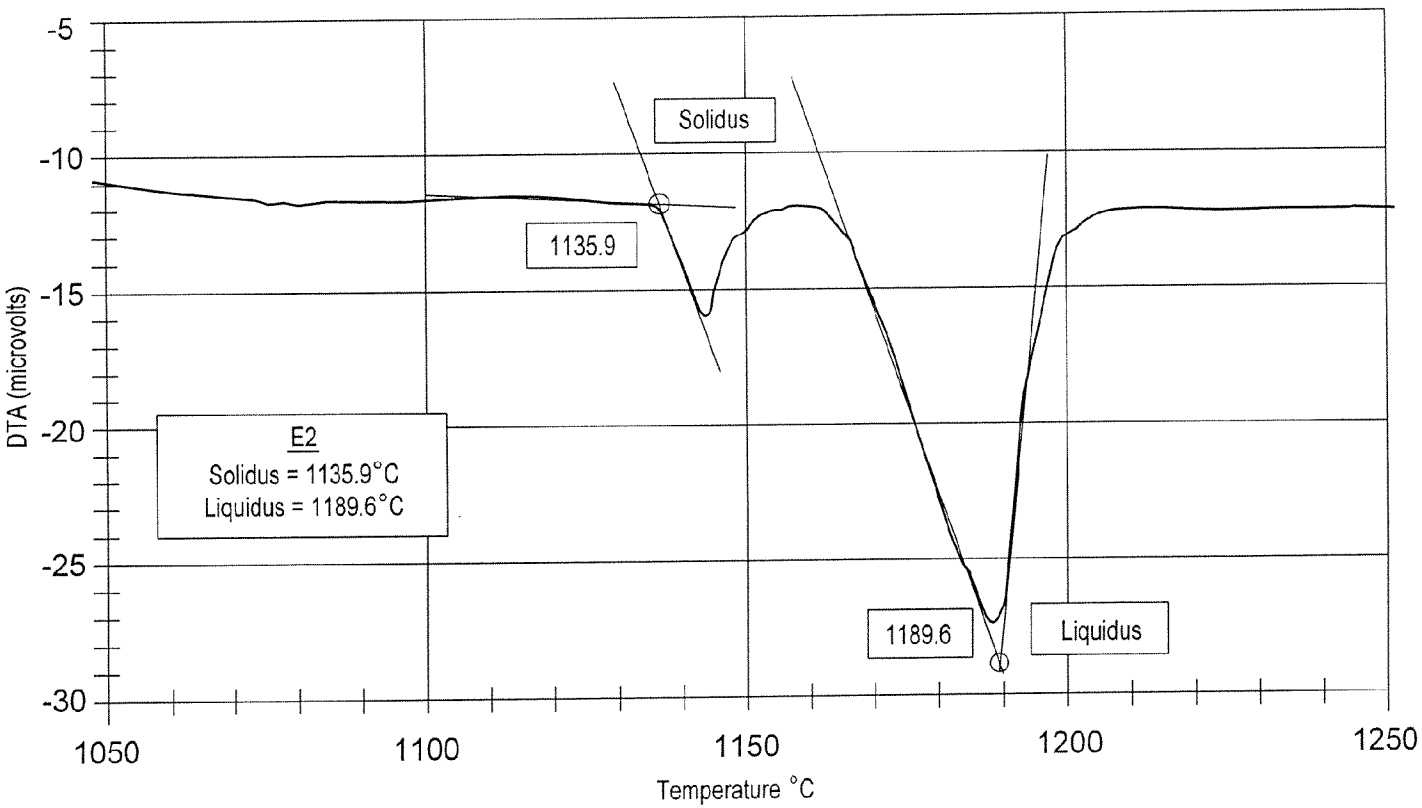
FIG. 6 is a graph of the results of a two-cycle DTA, from 900° C. to 1300° C. at a rate of temperature increase of 10° C./minute in an argon atmosphere, of a sample comprising about 88.4% nickel and about 11.6% silicon.

FIG. 6 is a graph of the results of a two-cycle DTA, from 900° C. to 1300° C. at a rate of temperature increase of 10° C./minute in an argon atmosphere, of a sample comprising about 88.4% nickel and about 11.6% silicon. The graph shows the melting point of the alloy to be approximately 1150° C.

Figure 7:
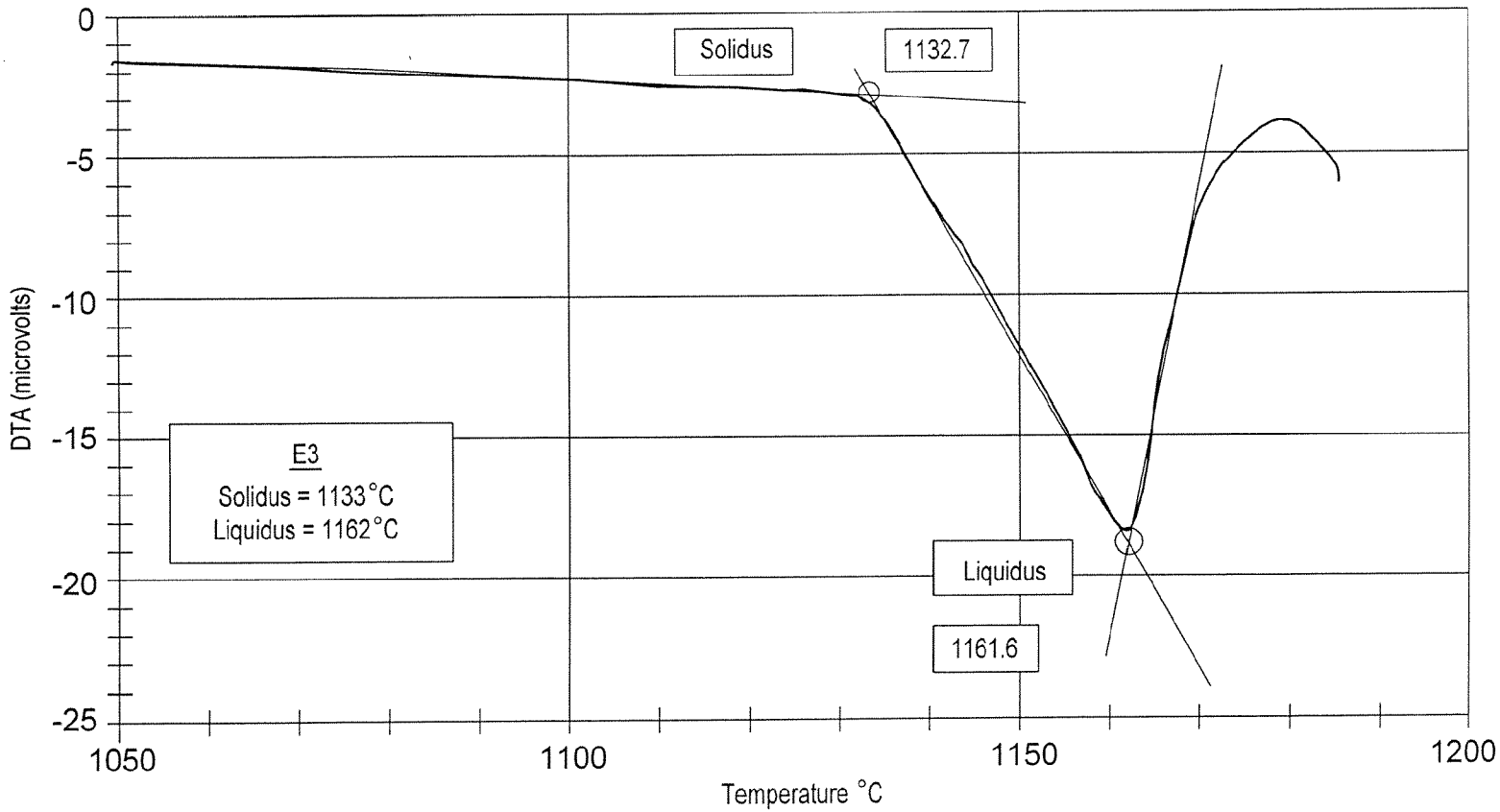
FIG. 7 is a graph of the results of a two-cycle DTA, from 900° C. to 1200° C. at a rate of temperature increase of 10° C./minute in an argon atmosphere, of a sample comprising about 96% cobalt and about 4% boron.

FIG. 7 is a graph of the results of a two-cycle DTA, from 900° C. to 1200° C. at a rate of temperature increase of 10° C./minute in an argon atmosphere, of a sample comprising about 96% cobalt and about 4% boron. The graph shows the melting point of the alloy to be approximately 1100° C.

Figure 8:
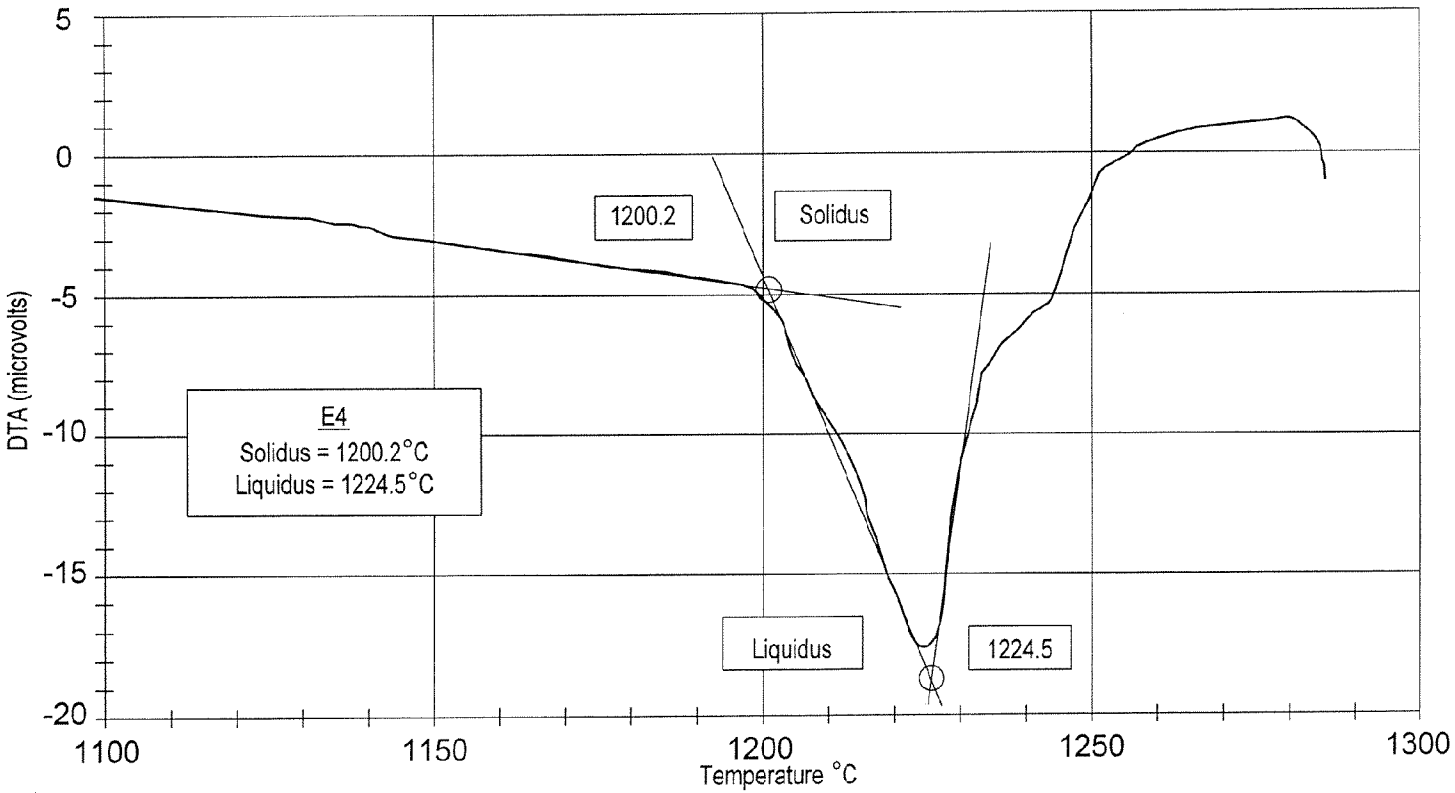
FIG. 8 is a graph of the results of a two-cycle DTA, from 900° C. to 1300° C. at a rate of temperature increase of 10° C./minute in an argon atmosphere, of a sample comprising about 87.5% cobalt and about 12.5% silicon.

FIG. 8 is a graph of the results of a two-cycle DTA, from 900° C. to 1300° C. at a rate of temperature increase of 10° C./minute in an argon atmosphere, of a sample comprising about 87.5% cobalt and about 12.5% silicon. The graph shows the melting point of the alloy to be approximately 1200° C.

Figure 9:
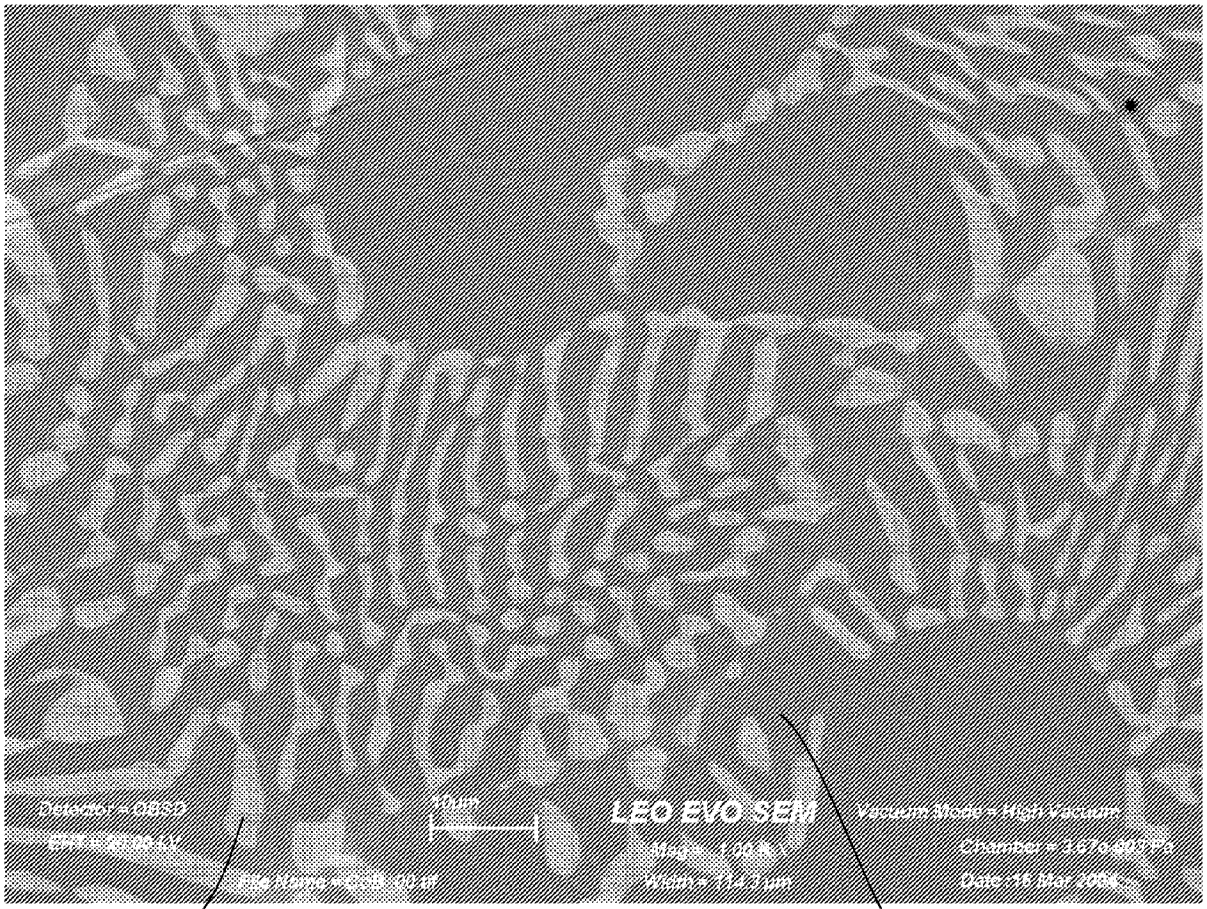
FIG. 9 is a scanning electron microscope (SEM) photomicrograph of a material produced by infiltrating a mass of hard particles with a binder consisting essentially of cobalt and boron.
Figure 10:
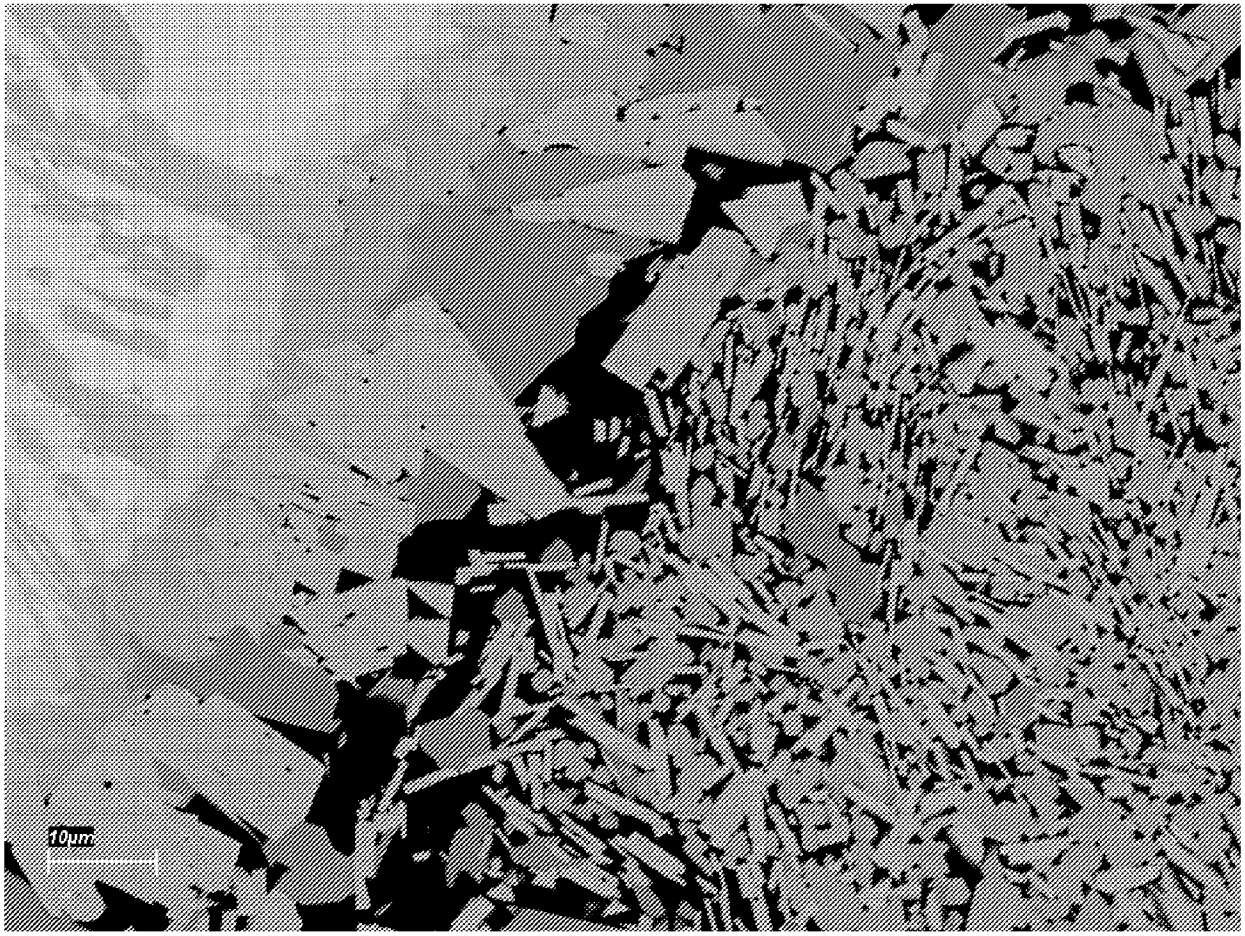
FIG. 10 is an SEM photomicrograph of a material produced by infiltrating a mass of hard particles with a binder consisting essentially of cobalt and boron.
Figure 11:
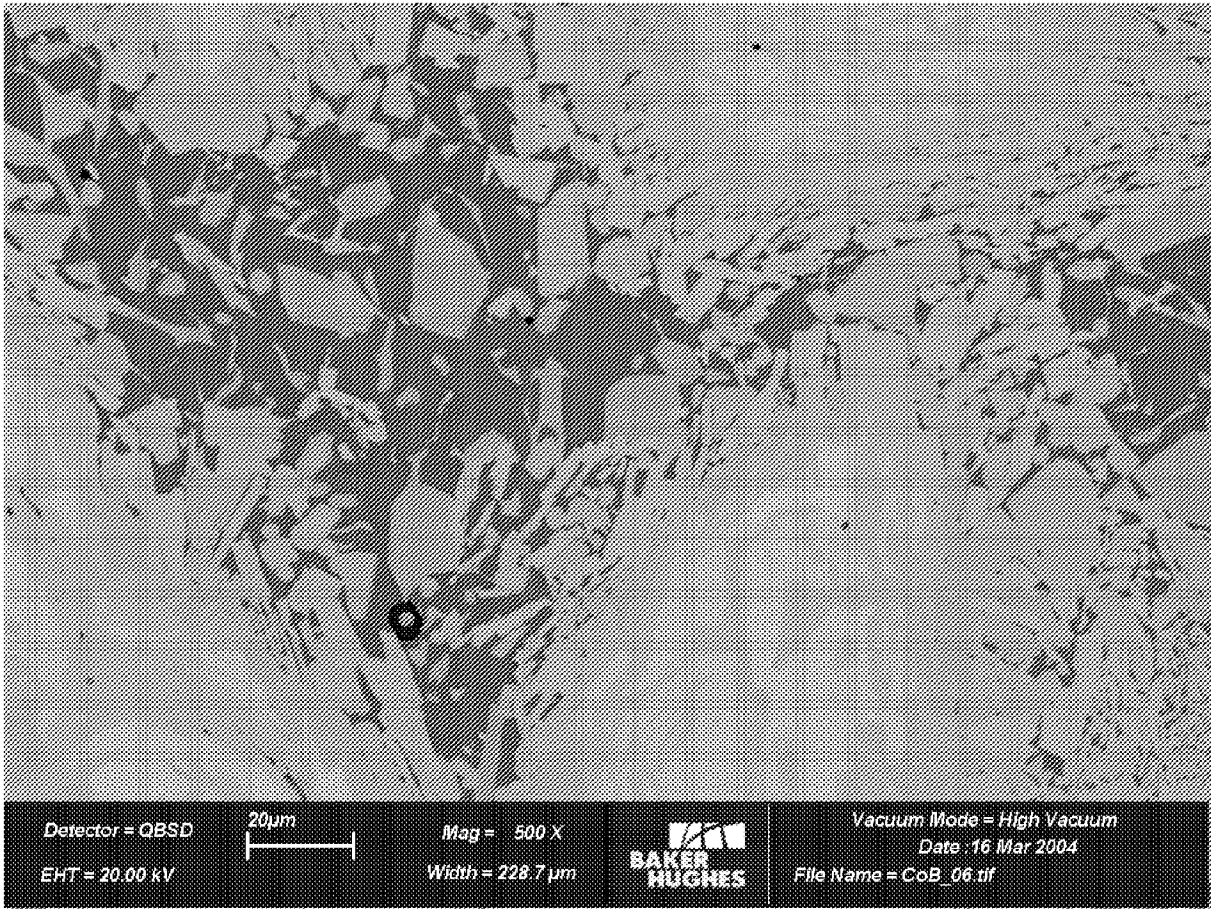
FIG. 11 is an SEM photomicrograph of a material produced by infiltrating a mass of hard particles with a binder consisting essentially of cobalt and boron.

FIGS. 9 to 11 show photomicrographs of materials formed by embodiments of the methods of the present invention. FIG. 9 is a scanning electron microscope (SEM) photomicrograph of a material produced by casting a binder consisting essentially of a eutectic mixture of cobalt and boron, wherein the boron is present at about 4 weight percent of the binder. The lighter-colored phase 92 is $Co_3B$ and the darker phase 91 is essentially cobalt. The cobalt and boron mixture was melted by heating to approximately 1200° C. then allowed to cool in air to room temperature and solidify.

Figure 12:
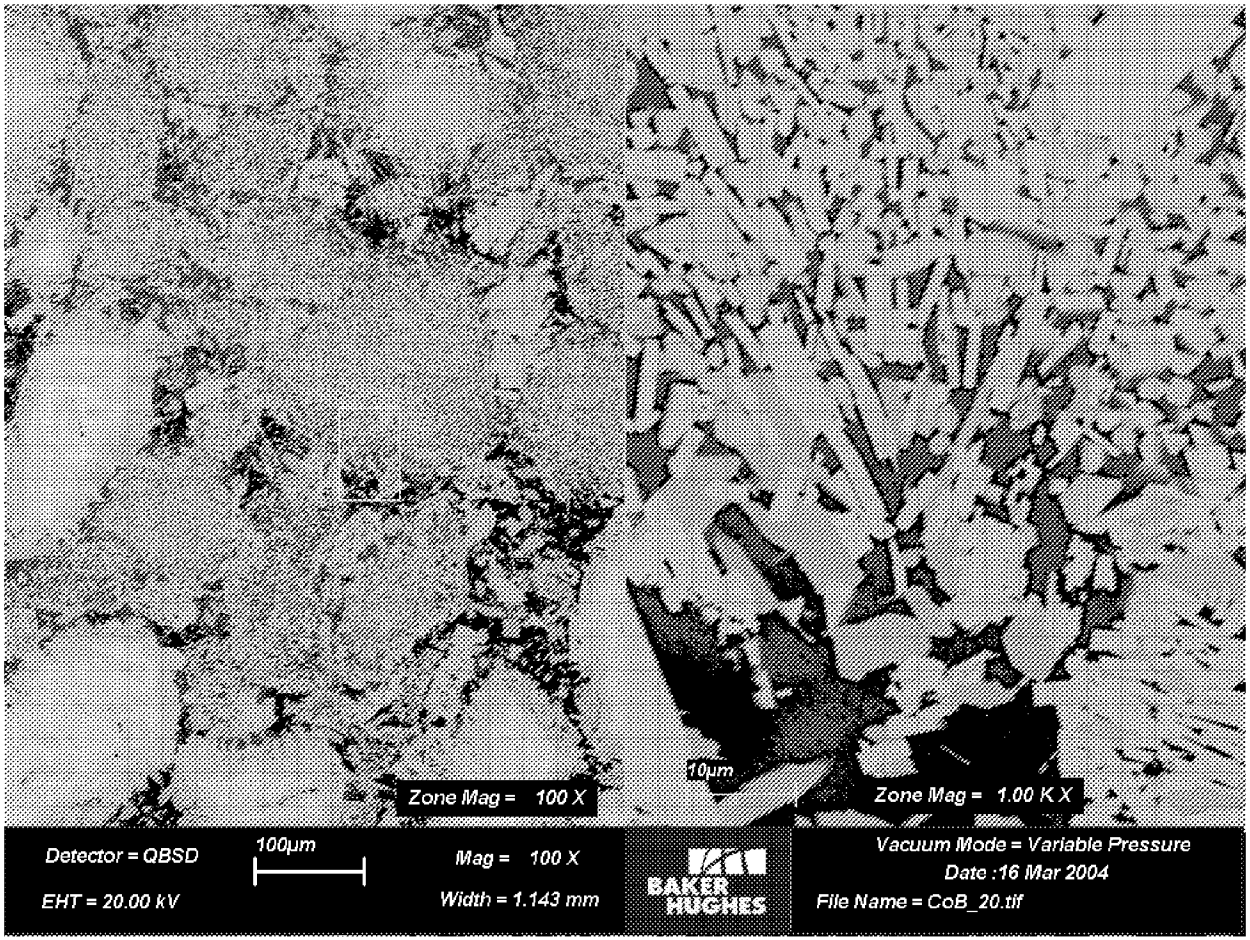
FIG. 12 is an SEM photomicrograph of a material produced by infiltrating a mass of hard particles with a binder consisting essentially of cobalt and boron.

FIGS. 10 to 12 are SEM photomicrographs of different pieces and different aspects of the microstructure made from the same material. The material was formed by infiltrating hard particles with a binder. The hard particles were a cast carbide aggregate ($W_2C$, WC) comprising approximately 60-65 volume percent of the material. The aggregate was infiltrated by a binder comprising approximately 96 weight percent cobalt and 4 weight percent boron. The infiltration temperature was approximately 1285° C.

Figure 13:
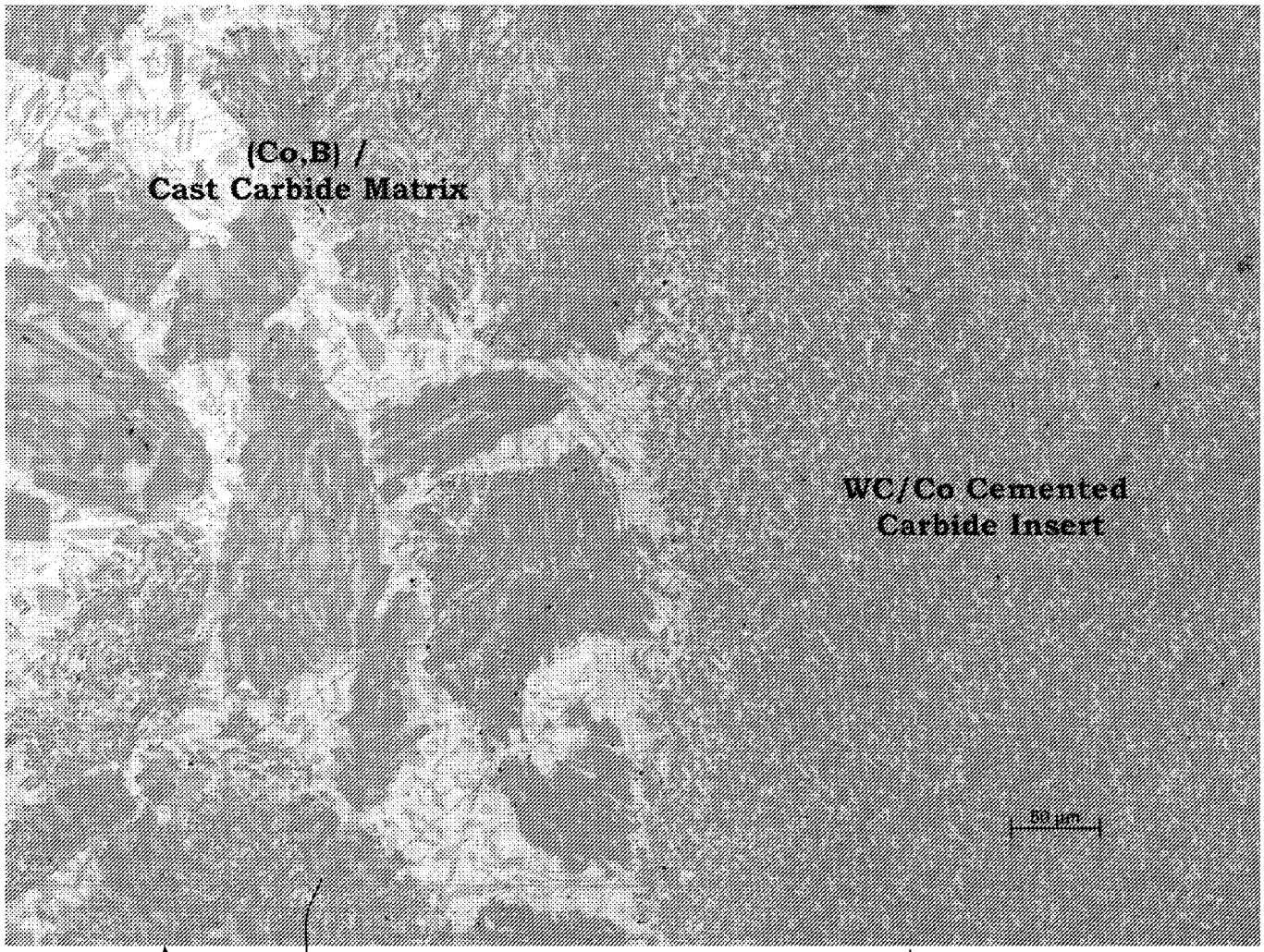
FIG. 13 is a photomicrograph of a material produced by infiltrating a mass of cast carbide particles and a cemented carbide insert with a binder consisting essentially of cobalt and boron.

FIG. 13 is a photomicrograph of a material produced by infiltrating a mass of cast carbide particles 130 and a cemented carbide insert 131 with a binder consisting essentially of cobalt and boron. To produce the material shown in FIG. 13, a cemented carbide insert 131 of approximately ¾" diameter by 1.5" height was placed in the mold prior to infiltrating the mass of hard-cast carbide particles 130 with a binder comprising cobalt and boron. As may be seen in FIG. 13, the infiltrated binder and the binder of the cemented carbide blended to form one continuous matrix 132 binding both the cast carbides and the carbides of the cemented carbide.

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although embodiments of the present invention have been described, one of ordinary skill in the art will, upon considering the foregoing description, recognize that many modifications and variations of the invention may be employed. All such variations and modifications of the invention are intended to be covered by the foregoing description and the following claims.

What is claimed is:

1. An earth-boring bit body, comprising:

a cemented tungsten carbide material comprising a discontinuous hard phase of tungsten carbide and a metallic binder, wherein the discontinuous hard phase of tungsten carbide comprises greater than 75 volume percent of the cemented tungsten carbide material.

2. The earth-boring bit body of claim 1, wherein the bit body is at least substantially comprised of the cemented tungsten carbide material.

3. The earth-boring bit body of claim 1, wherein the metallic binder comprises at least one of cobalt, iron, and nickel.

4. The earth-boring bit body of claim 3, wherein the metallic binder comprises at least 80 weight percent of at least of one of nickel, iron, and cobalt based on the total weight of the metallic binder.

5. The earth-boring bit body of claim 1, wherein the metallic binder further comprises silicon up to 20 weight percent based on the total weight of the metallic binder.

6. The earth-boring bit body of claim 1, wherein the metallic binder further comprises boron up to 10 weight percent based on the total weight of the metallic binder.

7. The earth-boring bit body of claim 1, wherein the metallic binder comprises nickel from 90 to 99 weight percent, and boron from 1 to 10 weight percent, each based on the total weight of the metallic binder.

8. The earth-boring bit body of claim 1, wherein the metallic binder comprises cobalt from 90 to 99 weight percent, and boron from 1 to 10 weight percent, each based on the total weight of the metallic binder.

9. The earth-boring bit body of claim 1, wherein the metallic binder further comprises at least one of a transition metal carbide, tungsten, carbon, boron, silicon, chromium, manganese, silver, aluminum, copper, tin, and zinc.

10. The earth-boring bit body of claim 9, wherein the metallic binder further comprises at least one of tungsten carbide, tungsten, carbon, boron, silicon, chromium, and manganese.

11. The earth-boring bit body of claim 1, further comprising a shank secured to the cemented tungsten carbide material and comprising an attachment means configured to secure the earth-boring bit body to a terminal end of a drill string.

12. A cast bit body, comprising:

a composite material having a microstructure including a hard ceramic phase and a metallic binder phase, wherein the hard ceramic phase comprises at least 75 percent by volume of the composite material; and a shank secured to the composite material and comprising an attachment means configured to secure the cast bit body to a terminal end of a drill string.

13. The cast bit body of claim 12, wherein the hard ceramic phase comprises at least one of a transition metal carbide, a transition metal boride, and a transition metal silicide.

14. The cast bit body of claim 13, wherein the hard ceramic phase comprises tungsten carbide.

15. The cast bit body of claim 12, wherein the metallic binder phase comprises a metal selected from at least one of cobalt, iron, and nickel.

16. The cast bit body of claim 15, wherein the metallic binder phase further comprises at least one of a transition metal up to 50 weight percent, boron up to 10 weight percent, silicon up to 20 weight percent, and manganese up to 25 weight percent.

* * * * *